United States Patent [19]

Tonkel et al.

[11] Patent Number: 4,656,760

[45] Date of Patent: Apr. 14, 1987

[54] CUSHIONING AND IMPACT ABSORPTIVE MEANS FOR FOOTWEAR

[75] Inventors: Raymond F. Tonkel, St. Louis County, Mo.; Alexander L. Gross, Suffolk County, Mass.

[73] Assignee: Kangaroos U.S.A., Inc., Chesterfield, Mo.

[21] Appl. No.: 705,659

[22] Filed: Feb. 26, 1985

[51] Int. Cl.[4] ..... A43B 13/18

[52] U.S. Cl. ..... 36/28; 36/30 R; 36/35 R

[58] Field of Search ..... 36/25 R, 27, 28, 29, 36/30 R, 30 A, 37, 44, 114

[56] References Cited

U.S. PATENT DOCUMENTS

| | | | |
|---|---|---|---|
| 508,034 | 11/1893 | Moore . | |
| 1,069,001 | 7/1913 | Guy . | |
| 1,506,975 | 9/1924 | Cooney . | |
| 1,923,169 | 8/1933 | Simmons | 36/44 |
| 1,942,883 | 8/1931 | Schaffer . | |
| 2,074,444 | 3/1937 | Warren . | |
| 2,407,495 | 9/1946 | High et al. . | |
| 2,425,386 | 8/1947 | Oestricher . | |
| 2,437,227 | 3/1948 | Hall . | |
| 2,605,560 | 8/1952 | Gouabault . | |
| 2,627,676 | 2/1953 | Hack . | |
| 2,649,391 | 8/1953 | Alderfer . | |
| 2,721,400 | 10/1955 | Israel . | |
| 3,005,272 | 10/1961 | Shelare . | |
| 3,765,422 | 10/1973 | Smith . | |
| 3,785,069 | 1/1974 | Brown . | |
| 3,785,646 | 1/1974 | Ruskin . | |
| 3,871,117 | 3/1975 | Richmond et al. . | |
| 3,906,185 | 9/1975 | Gross et al. . | |
| 3,918,181 | 11/1975 | Inohara . | |
| 4,005,532 | 2/1977 | Giese et al. . | |
| 4,012,854 | 3/1977 | Berend et al. . | |
| 4,024,586 | 5/1977 | Lamb | 2/414 |
| 4,031,579 | 6/1977 | Larned | 297/453 X |
| 4,054,706 | 10/1977 | Shapiro . | |
| 4,062,131 | 12/1977 | Hsiung . | |
| 4,073,072 | 2/1978 | Gross et al. . | |
| 4,099,342 | 7/1978 | Singh . | |
| 4,132,228 | 1/1979 | Green | 297/459 X |
| 4,151,660 | 5/1979 | Yoshimi et al. . | |
| 4,167,824 | 9/1979 | Wolpa . | |
| 4,185,402 | 1/1980 | Digate . | |
| 4,186,499 | 2/1980 | Massok, Jr. et al. . | |
| 4,187,620 | 2/1980 | Selner . | |
| 4,194,310 | 3/1980 | Bowerman . | |
| 4,219,945 | 9/1980 | Rudy | 36/29 |
| 4,223,458 | 9/1980 | Kihara . | |
| 4,236,326 | 12/1980 | Inohara . | |
| 4,257,176 | 3/1981 | Hartung et al. . | |
| 4,262,433 | 4/1981 | Hagg et al. . | |
| 4,267,648 | 5/1981 | Weisz . | |

List Continued on next page.

OTHER PUBLICATIONS

High Technology, Mar. 1985, pp. 28–34.

*Primary Examiner*—Werner H. Schroeder
*Assistant Examiner*—T. G. Graveline
*Attorney, Agent, or Firm*—Paul M. Denk

[57] ABSTRACT

This invention pertains to the encapsulation of a cellular insert, in the form of cellular components, formed of woven material fabricating such cellular components that present voids or cavities therein, or which may be formed from spirally or helically wound strands of a polymer having a hardness exceeding that of the foamed or other polymer composition in which the insert locates, as within the structure of a sole for an athletic shoe. The cellular insert may be formed of a series of woven or wound cellular shaped components, having the voids therein, and which may be arranged intermediate a pair of liners, which also may be of woven material, in order to provide for its rather proper location within the structure of the polymer foamed shoe sole, be totally embedded therein, but yet very effectively function as a means for cushioning or absorbing the forces of impact exerted upon the shoe sole during application of the athletic shoes during participation within a variety of sporting events, such as football, basketball, jogging, court playing, or the like.

12 Claims, 22 Drawing Figures

U.S. PATENT DOCUMENTS 4,272,899 6/1981 Brooks .
4,283,864 8/1981 Lipfert .
4,297,796 11/1981 Stirtz et al. ..... 36/28
4,316,332 2/1982 Giese et al. .
4,322,891 4/1982 Inohara .
4,322,892 4/1982 Inohara .
4,325,194 4/1982 Inohara .
4,364,188 12/1982 Turner et al. .
4,364,189 12/1982 Bates .
4,380,878 4/1983 Skaja .
4,391,048 7/1983 Lutz .
4,398,357 8/1983 Batra .
4,430,810 2/1984 Bente .
4,485,568 12/1984 Landi et al. ..... 36/28 X
4,535,553 8/1985 Derderian et al. ..... 36/28
4,536,974 8/1985 Cohen ..... 36/28
4,551,930 11/1985 Graham et al. ..... 36/30 R
4,561,195 12/1985 Onoda et al. ..... 36/28 X

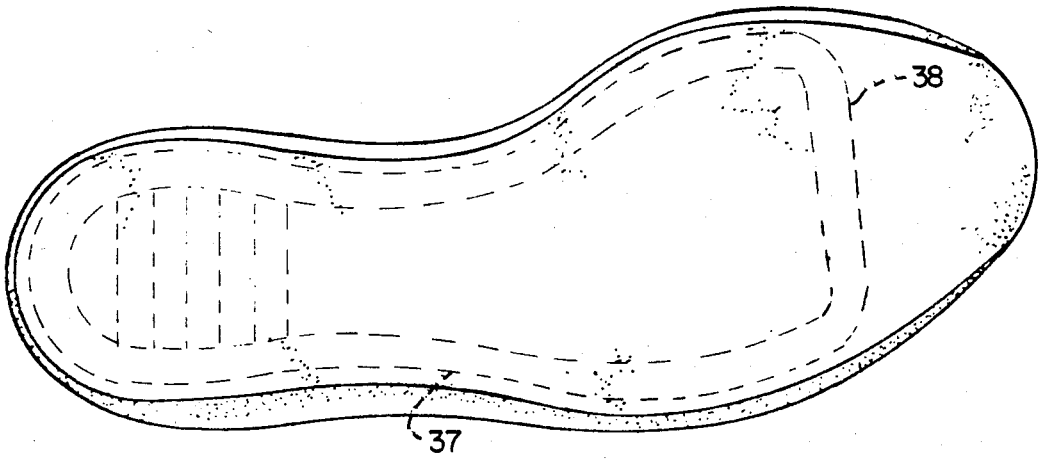
FIG. 14.
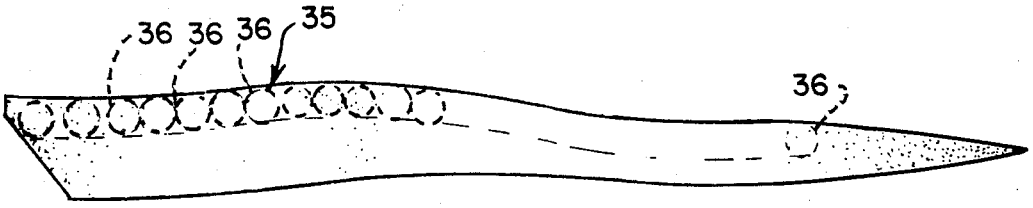
FIG. 15.
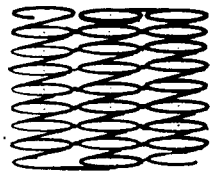
FIG. 16.
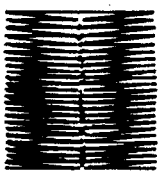
FIG. 18.
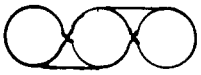
FIG. 17.
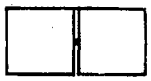
FIG. 19.
FIG. 20.
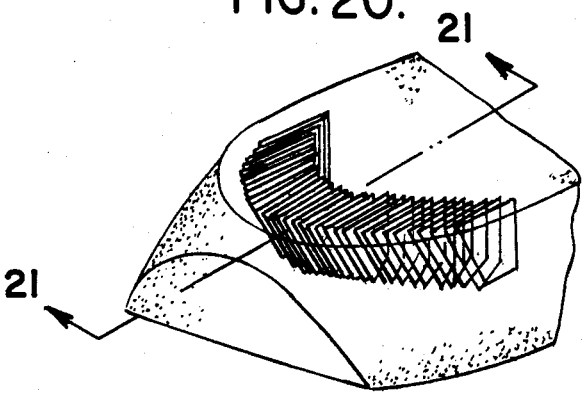
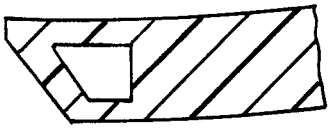
FIG. 21

CUSHIONING AND IMPACT ABSORPTIVE MEANS FOR FOOTWEAR

BACKGROUND OF THE INVENTION

This invention relates generally to fabrication of footwear, more specifically athletic shoes, and particularly pertains to the application of cellular insert means within the structure of the sole for these types of shoes and which effectively resists the transmission of the forces of impact encountered by the footwear and its wearer during application.

In participation within sporting events, such as court events like tennis and basketball or in sports such as, football, track, or while partaking in various running events, such as jogging, or the like, or even in the customary application of footwear, as for daily or casual usage, frequently the footwear wearers will encounter the strain and ordeal of sustained pressure or the encountering of impacting forces, particularly during participation in the identified athletic type events, and which exposure does have a tendency to cause injury and damage to the particpant. Anyone who has been active in the sport of basketball, as an example, can readily understand the stress endured from what has been identified as a stone bruise, normally which apparently comprises the bruising to the flesh surrounding the lower oscalcis, or heel bone, and which normally occurs from the repeated jumping undertaken by a participant in such an athletic event. In addition, there are a variety of other types of normally muscle stressing and bruising impairments sustained by the athlete, or even those that do an abundance of walking, or perhaps even sustained by lengthy standing, which ordinarily occurs because of the direct impact of force encountered when the footwear worn by such people abruptly contact the ground, as during shoe usage. As a result, there has been given a significant amount of thought to modifications to shoe structures, particularly the sole component, of footwear, and more specifically athletic shoes, in an effort to combat that type of damage sustained by the foot generally during activity undertaken through athletic shoe usage. For example, one such modification to the sole of a sports shoe can be seen in Bente, U.S. Pat. No. 4,430,810, wherein elastically flexible material is inserted within the heel wedge portion of an athletic shoe in order to dampen the vibrations and shock occurring which running, especially upon a hard track. But, in this particular instance, the method for alleviating those problems apparently includes the insertion of various bar shaped support members into apertures provided within the urethane formed sole for the therein disclosed athletic shoes. Other means for alleviating these particular problems is to simply provide a series of apertures within the shoe sole, such as shown in the exercising device formed as an attachment to the sole of a shoe as disclosed in Ruskin, U.S. Pat. No. 3,785,646. Another concept for alleviating the forces encountered by the athlete during usage of the sports shoe, and which is similar to that explained in the aforesaid Ruskin patent, is the provision of a series of arch like apertures arranged within at least the heel portion of such a shoe, as disclosed in Inohara, U.S. Pat. No. 4,236,326.

Stil further methods have been employed for attempting to cushion the foot against impacting forces, and many such developments have been of rather complex structure, such as by vertically arranging modules of a plurality of cushioning structures which have a tendency to spread out the forces of impact before they are transmitted to the foot of the athlete. Such is shown in the U.S. Pat. No. 4,283,864 to Lipfert.

Yet other methods for attempting to resolve the transmission of impacting forces to the foot of the athlete include fabricating the overall sole of the athletic shoe with different forms or densities of material, as by putting a more denser material at the vicinity of the heel portion of the shoe, while arranging more softer textured material at the midsole or front of the shoe sole. Such is shown in Bates, U.S. Pat. No. 4,364,189.

There are a large variety of other designs that have been built into footwear, and more specifially athletic shoes, and which relate to the foregoing, such as shown in Giese, U.S. Pat. No. 4,316,332, in addition to his other U.S. Pat. No. 4,316,335. The patent to Gross, one of the inventors herein, U.S. Pat. No. 4,073,072, shows an air circulation material constructed into the proximate sole portion for the shown shoe. In addition, insulated insole construction is disclosed in another Giese, U.S. Pat. No. 4,005,532. The addition of stabilizer means to the rear sole portions of an athletic shoe are shown in Turner, U.S. Pat. No. 4,364,188. A shoe outsole upon an athletic shoe is disclosed in Skaja, U.S. Pat. No. 4,380,878. A sports shoe sole having voids therein primarily to prevent slippage, is disclosed in Inohara, U.S. Pat. No. 3,918,181. A sports shoe sole having included ribs for cushioning purposes are disclosed in Inohara, U.S. Pat. No. 4,325,194. A related type of midsole insert and which includes shaped apertures for cushioning purposes is generally disclosed in Inohara, U.S. Pat. No. 4,322,892. Another Inohara patent pertaining to a sports shoe sole structure is shown in his U.S. Pat. No. 4,322,891. Air-flow characteristics built into the sole structure of a shoe is disclosed in Batra, U.S. Pat. No. 4,063,371. Likewise, providing apertures within the sole, also for shock absorbing purposes, is disclosed in Famolare, U.S. Pat. No. 4,078,321.

The build up of structures within the sole component, as previously explained with respect to the Lipfert patent, has been further modified within related types of elastic sole formations, such as shown in Lutz, U.S. Pat. No. 4,391,048. Incorporation of related types of integral spring systems within a shoe sole is disclosed in Weisz, U.S. Pat. No. 4,267,648. Raised apertures provided within an outsole portion for a shoe are disclosed in Batra, U.S. Pat. No. 4,398,357. And, another form of sole body for footwear providing more compressibility within its heel structure is disclosed in Hagg, U.S. Pat. No. 4,262,433. Likewise, a biomechanical shoe structure, that is intended to reduce the likelihood of injury or deterioration to the human foot, is shown in Selner, U.S. Pat. No. 4,187,620. Elastic shoe sole fabrication particularly for a sandal, disclosing a series of stud like structures, intermediate a pair of spaced sole members is disclosed in Giaccaglia, U.S. Pat. No. 4,222,185. The Israel patent No. 2,721,400, discloses a cushioned shoe sole. Related type of structure is shown in Hall, U.S. Pat. No. 2,437,227. The provision of apertures and studs located in or extending downwardly from the sole of an athletic shoe is disclosed in Brooks, U.S. Pat. No. 4,272,899. And, foot cushioning device, apparently for an application to the heel of the shoe, before it is structured into footwear, is disclosed in Davidson, U.S. Pat. No. 4,179,826.

The location of a spring means within the heel structure of an athletic shoe is disclosed in McMahon, U.S. Pat. No. 4,342,158. The Saarista, U.S. Pat. No. 4,102,061, discloses vertical apertures provided within an insole insert, proximate the heel portion for disclosed shoe structure. An article of footwear incorporating various suction cups upon the bottom of its sole, apparently also for cushioning purposes, is disclosed in Semon, U.S. Pat. No. 4,118,878. Substantial voids provided within the bottom of a shoe sole, for skid preventing purposes, is disclosed in the footwear patent to Gardner, U.S. Pat. No. 3,568,340. A running sole of flexible synthetic material for a sports shoe, of the type that forms rather diamond shaped grid work of cross bars, apparently for slip resistant purposes, is disclosed in Dassler, U.S. Pat. No. 3,808,713. The provision of a hollow interior for the sole of the footwear, for cushioning purposes, is disclosed in Fukuoka, U.S. Pat. No. 3,608,215. Inclusion of additional cavities within a shoe sole are shown in Cohen, U.S. Pat. No. 4,223,456, in addition to Plagenhoef, U.S. Pat. No. 4,235,026. Similar type of cavities formed within a shoe sole are disclosed in Rudy, U.S. Pat. No. 4,271,606. The Berend patent discloses an inflatible shoe, for cushioning purposes, as shown in his U.S. Pat. No. 4,012,854. Other types of cushioning means for shoe soles include the pneumatic style as disclosed in Moore, U.S. Pat. No. 508,034, and Guy, U.S. Pat. No. 1,069,001. And, Cooney, U.S. Pat. No. 1,506,975, discloses a similar type of sole structure. Schaffer, U.S. Pat. No. 1,942,883, shows a related type of pneumatic shoe. A corrugated sole and heel tread for shoes is disclosed in Hack, U.S. Pat. No. 2,627,676. Fluid filled inner soles are disclosed in Richmond, U.S. Pat. No. 3,871,117, while an air enclosed cavity for a shoe sole is shown in Brown, U.S. Pat. No. 3,785,069.

Thus, as the foregoing indicates, there are a voluminous number of shoe and sole structures designed principally for the provision of cushioning for the shoe, to protect the foot, as during the footwear application. On the other hand, as can be seen from the herein described invention, the concept of incorporating a cellular insert, generally formed of a woven or wound polymeric material, wherein the woven or helical wound cellular component is embedded within particular locations of the sole structure, and generally having its internal cavities filled with either the same or other textured polyurethane or other polymer foam that forms the shoe sole has apparently just never been revealed in the prior art.

It is, therefore, the principal object of this invention to add a cellular insert into the construction of a generally foam formed sole for footwear, and more specifically an athletic shoe, for the purpose of resisting and dampening the transmission of the forces of impact from the ground, through the shoe sole, and to the foot of its wearer.

Another significant object of this invention is to furnish the athlete with means for attaining energy efficiency and conservation by emedding within the shoe sole the insert of this invention for providing sustained rebound capacity resulting in greater energy return with each foot stride, therefore reducing foot fatigue, as well as actually reducing the energy necessary to run at a given pace.

A further object of this invention is to provide a cellular coil system that is embedded at particular locations within the shoe sole, and which is predetermined and designed for resisting specific directional forces of impact encountered by the shoe during usage by the athlete or other person.

Another object of this invention is to design into the construction of the sole of an athletic or other shoe preferably a woven polymer cellular insert that adds multi-dimensioned densities to the shoe sole construction and which effectively resist forces of impact.

An object of this invention is to embed the cellular insert of this development into a walking shoe.

More specifically, another object of this invention is to provide for the integral incorporation of a cellular woven or spirally wound fabric into precise locations for various styles of shoes in order to resist the forces of impact that may be encountered by select shoes during participation within specific athletic endeavors, such as athletic shoes that may be used during basketball, to resist the directly downward forces of impact, or perhaps in running shoes, wherein the main thrust of force is encountered upon the heel portion of its shaped sole.

These and other objects will become more apparent to those skilled in the art upon reviewing the summary of this invention, and upon undertaking a study of the description of its preferred embodiment, in view of the drawings.

SUMMARY OF THE INVENTION

This invention contemplates the locating integrally within particular portions of the sole structure for footwear, and more specifically an athletic shoe, flexure style of woven or wound material, such as of polymer, nylon, or the like, and which is designed having a higher Durometer or Shore hardness than that of the surrounding foam, such as urethane foam, from which the basic sole structure is fabricated, in order to effectively resist the forces of impact encountered by the foot of the athlete during participation within rather vigorous sporting events. Such woven material may be of the resilient type, being flexible in texture, but having sufficient hardness to return to its initial structural shape after deformation. Also, it can resist pressure exerted upon it. By way of example, it is well known that the athlete, such as a basketball player, when descending from a jump, may sustain impacting forces many times greater, such as three to four times his own weight, so that when an athlete such as of the two hundred pound class, hits the floor upon a descent, the forces of impact upon the shoe sole may be in the range four to six hundred pounds. These are significant forces, and when repeatedly encountered by the athlete while strenuously partaking within such an event for any duration, can lead towards fatigue, and eventually injury, over a period of time. Hence, the essence of this invention is the incorporation of means to absorb or resist the transmission of these forces to innersole of the foot of the athlete, through the application and usage of the herein designed footwear, incorporating the cellular insert of this particular invention.

This invention generally envisions the formation of a woven like fabric of material, having a series of cellular components, exhibiting sine wave characteristics, formed intermediate a pair of fabric layers, the cavities formed within the interior of the components being either void, or filled with the same or different foam like material from which the shoe sole is constructed. In any event, the Durometer hardness of this cellular insert is greater, as much as two to eight or more times, the hardness of the foam in which it is implanted, and thus, due to the circular or spiral pattern formed of the cellular component, and which also may be helical wound in its construction, the forces of impact are absorbed by these plurality of structures, in order to resist the transmission of these forces from the ground and to the athlete's foot. As is well known, soles formed alone from the polyurethane liquid foam system exhibit just poor shock absorbing characteristics.

The cellular insert, forming the components, may be arranged at particular locations within the athletic shoe, depending upon the style of sporting event for which the shoe is predesigned. For example, in the standard athletic shoe, the coil or component system of the cellular insert may be arranged substantially centrally and along the length of the formed sole. On the other hand, where a jogging shoe is involved, dual or more layers of the cellular insert may be located integrally within the head-sole structure for the shoe, in order to be more effective in resisting direct forces encountered by the runner as the heel repeatedly impacts directly upon the ground during the repeat running motion. Alternatively, in a basketball style of shoe, the system designed as most effective is the arrangement of the cellular coil unit along the upper surface of the shoe sole, just under and in proximity of the shoe inner sole, in order to provide for resistance against the transmission of the forces along the entire length of the shoe sole, since, during participation in basketball, the forces of impact are encountered from a variety of directions upon the underside of the shoe.

In addition, the cellular insert may be located transversely of the shoe, longitudinally of the same, or in a variety of other angular directions, all as believed to provide the most effective resistance against force transmission through the sole for the athletic shoe. Furthermore, the cellular insert may be located within a seperately formed midsole portion for the sole, and then encapsulated within the overall sole structure, as it is fabricated into the finished athletic shoe. In addition, the woven structure for the cellular insert may include, or be seperately formed, as spirally wound stand of polymer, or related materials, having Durometer or Shore hardness generally exceeding that of the foam material in which it inserts, in order to resist against force transmission. Furthermore, these wound cellular components may be particularly shaped, such as having flattened upper and lower surfaces, and be perpendicularly arranged, in order to resist directly against the line and direction of force transmission, such as along the upper and lower surfaces of the shoe sole. Or, at the heel portion of the jogging or running style of shoe, the shaped woven fabric may have flattened or related surfaces designed for exposure substantially perpendicularly to the direction of transmission of the impact forces, in order to better absorb such pressures, and to resist against their transmission to the foot.

BRIEF DESCRIPTION OF THE DRAWINGS

In referrring to the drawings.

FIG. 14 provides a top view of a running shoe sole, similar to that disclosed in FIG. 3, showing the arrangement of various cellular components disposed both transversely and longitudinally within the sole structure for a running shoe;

FIG. 15 provides a side view of the running shoe shown in FIG. 14, disclosing the cellular insert located proximate the upper surface of the shoe sole;

FIG. 16 discloses a modification to the woven cellular insert of this invention, in this particular instance, comprising a spirally, helically, or otherwise wound material for locating as an insert within the sole of an athletic shoe;

FIG. 17 is an end view of the wound material disclosed in FIG. 16;

FIG. 18 discloses a modification to the woven cellular insert of this invention, in this particular instance comprising a spirally, helically, or otherwise wound material and shaped for locating as an insert within the sole of an athletic shoe;

FIG. 19 is an end view of the wound material disclosed in FIG. 18;

FIG. 20 discloses the heel end of a sole for an athletic shoe, disclosing a cellular insert of the wound type embedded therein and which has particular shaped or flattened surfaces for convenient disposition within the athletic shoe sole, and for resisting against the transmission of the forces of impact encountered by it during its application;

FIG. 21 provides a sectional view of the embodiment disclosed in FIG. 20, taken along the line 21—21 of said Figure.

DESCRIPTION OF THE PREFERRED EMBODIMENT

Figure 1:
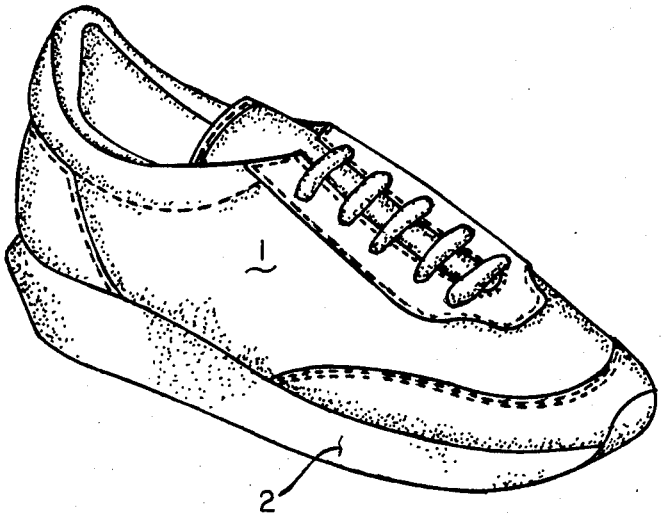
FIG. 1 is a perspective view of an item of footwear, and more particularly an athletic shoe.
Figure 2:
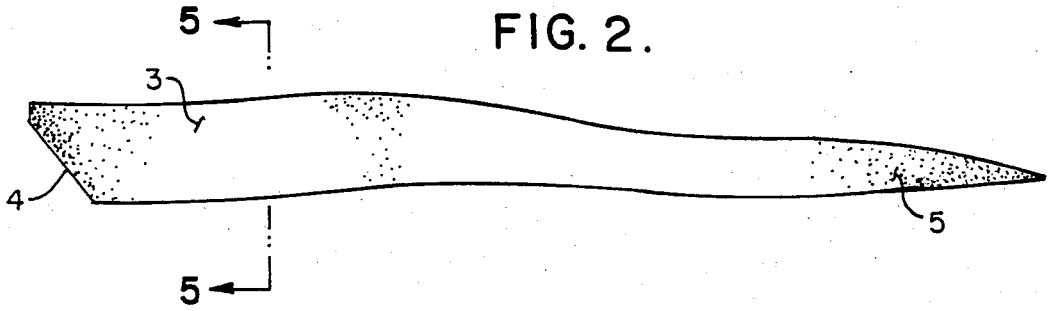
FIG. 2 is a side view of the shoe sole.
Figure 3:
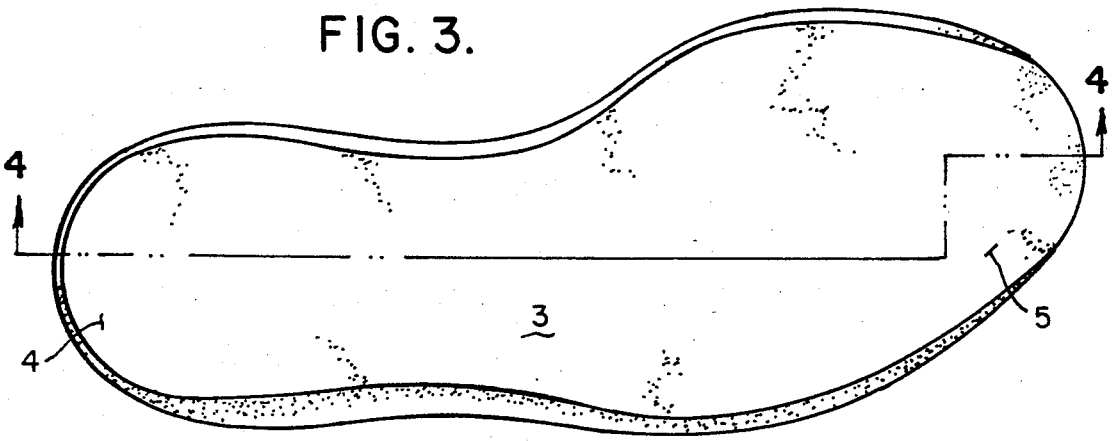
FIG. 3 is a top view of the shoe sole.

In referring to FIGS. 1 through 3, the basic configuration of a shoe, and more specifically an athletic shoe, is readily shown, comprising a shoe upper 1 integrally secured with its sole portion 2, which in this particular instance, the sole is designed for footwear usage as a running shoe, wherein generally the shoe incorporates a rather thickened heel portion, as at 3, having an inclining segment 4, which is generally that portion of the shoe that initially repeatedly contacts the ground during running. The frontal portion of the shoe usually tapers into a thin line dimension, as at 5, and then wraps upwardly about the toe cap for the shoe upper.

Figure 4:
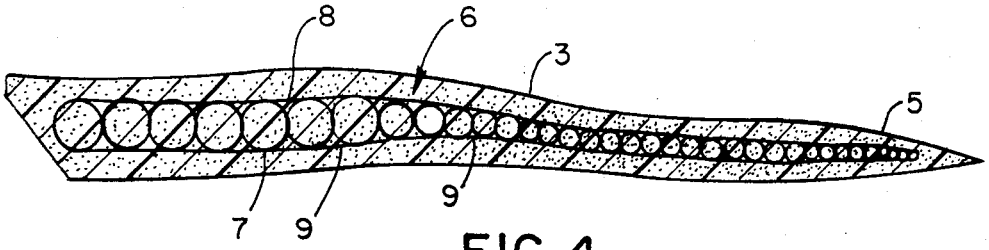
FIG. 4 is a longitudinal sectional view taken along the line 4—4 of FIG. 3, disclosing the cellular insert embedded within the shoe sole.

More specifically, as can be seen in FIG. 4, the concept of the this invention comprising the insole insert, as at 6, is integrally fabricated within the construction of the said sole portion, as it is formed during shoe fabrication. Essentially, as previously described, the shoe soles normally are fabricated as a polyurethane or other foamed or solid polymer, formed in the mold, and then applied to the shoe upper. Or, under more current technology, in certain instances the sole portion for the athletic shoe may be foamed or formed in place, in its securement to the shoe upper, during footwear fabrication.

More specifically, with respect to this invention, the cellular insert 6 comprises the various cellular components, as at 7, including a series of annular like portions, which are linked together by means of upper and lower linking or lining means 8 and 9, respectively, which have a tendency to weave the cellular components together into a fabricated structure.

Figure 8:
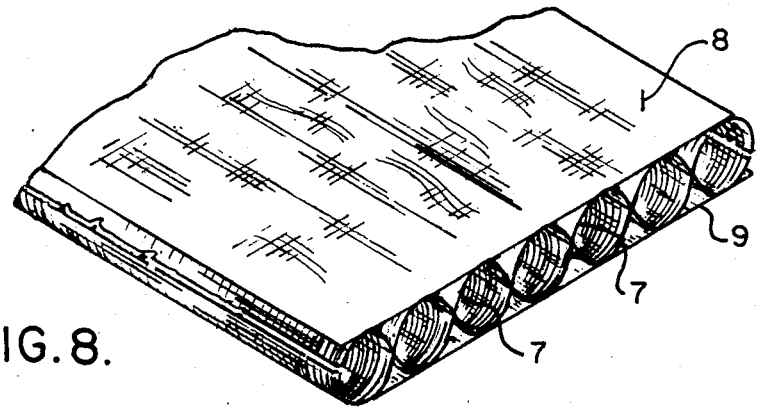
FIG. 8 shows a woven cellular insert of this invention, before its embedding within the sole of an athletic shoe.

In the preferred embodiment, the cellular insert of this invention generally is formed of a woven material, generally of a polymer, such as nylon, of polypropylene, polyethylene, or of other monofilament or copolymer structures, and as can be seen in FIG. 8, comprising an upper layer of material 8, as previously referred to, having a lower woven liner 9 with the series of cellular components 7 arranged intermediate thereof. The intermediate layer is preferably formed of a pair of inverted, with respect to each other, sine wave configured inter meshing layers of woven material that forms together the cellular like components for the insert of this invention. In this configuration, any pressure exerted upon the liners is exerted to the components 7, which when spread apart, or tending to flatten, force against each other to function as a buffer and pressure absorber. This is not too unlike corrugations of fabricated board. And, this particular material may be located in place within the mold for forming of the foamed shoe sole, so that when the sole is fabricated, from generally a polyurethane or other foam, or other polymer material, the cellular insert will be located in place embedded integrally within the formed sole. As can be seen, as in FIG. 4, the cellular insert may comprise a series of the cellular components 7, which may be of consistent diameter, such as of one-half inch, more or less, and then reducing in size, so as to be conveniently accommodated within even the front portion of the sole, as at 5, as can be seen.

As also previously described, the polymer material forming the cellular insert of this invention may be formed of a variety of materials, generally of polymer construction, such as polypropylene or polyethylene, or the like, and will have a Durometer or Shore C hardness in the range in excess of that preferred hardness for the fabricated sole material. In addition, as also previously explained, the liquid formed foam material normally fabricating the sole portion 3 for an athletic shoe is in the range of a Shore hardness of between about 20 to 60, and density of about 0.08 to 0.5, for a basketball type shoe, although in the preferred and usual commercially fabricated athletic shoe, the sole will be of a Shore hardness approximating 50. As a further example, a tennis shoe will normally have a Shore C hardness of between 65 to 72, comprising a density of about 0.50 to 0.63. Hence, as explained, the hardness of the material forming the cellular insert of this invention is of a hardness generally exceeding that of the foamed sole, and therefore, due to its particular configuration, functions as a resistor and dampener against the transmission of an forces of impact through the sole and to the foot of the athlete wearing the designed shoes.

Figure 5:
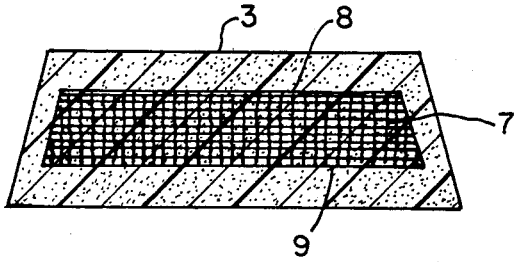
FIG. 5 is a transverse sectional view taken along the line 5—5 of FIG. 2, disclosing one of the cellular components of the insert for the shoe.

As can be seen in FIG. 5, which is a cross section of the heel portion of the sole taken from FIG. 2, the cellular insert fits compactly within the sole structure, and disposes its upper layer of woven material 8 equispaced from the upper surface of the sole embodiment and arranged intermediately with the lower layer of material 9 with the various cellular components 7. Thus, as can be understood, the cellular components function in the nature of a compound arch within the sole structure, and have a tendency to resist forces exerted substantially diametrically of their location within the sole structure. Hence, provision of a substantially flattened upper and lower layers 8 and 9 for the woven material functions as means for initially absorbing any forces of impact exerted upon the sole structure, with the cellular inserts 7 tending to furnish resistance or absorption of any of these forces through the principle of compression so as to effectively minimize their transmission through the sole structure and to the foot of the athlete.

For a running shoe, the usual foamed sole has a Shore C hardness of about 47 to 53, with a density of about 0.18 to 0.19. On the other hand, the heel structure of such a shoe may be formed of a more hardened foam or other polymer material to more effectively resist against the forces of impact. For example, forming the heel segment from a foam having a Shore C hardness of about 60 to 65, and a density range of between about 0.20 to 0.21, has been an improvment.

Figure 6:
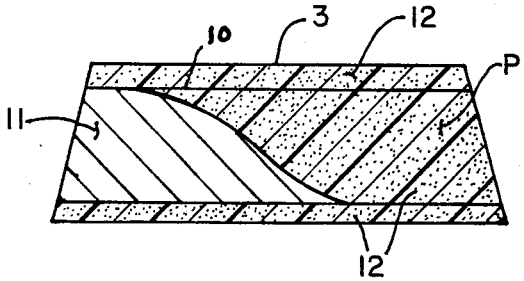
FIG. 6 discloses the locating of a cellular component within the sole of the shoe, and shows the location of various foamed shock absorbing plugs arranged therein.

FIG. 6 discloses the sole structure showing schematically, as at 10, one of the cellular components therein, and incorporating internally of any cellular component various inserts, of encapsulated foam material, as at 11, which may be of a different, either lighter or heavier, density from that foam 12 forming the basic sole structure 3 for the athletic shoe. Thus, having a foamed insert arranged internally of the cellular component 10, such insert as shown at 11, and being of a different density from that formed of the sole structure per se, perhaps of a thicker density, functions to provide for compound resistance against forces of impact in order to shelter the foot of the athlete at various locations and where the most pointed and direct forces may be encountered by various portions of the foot during shoe usage.

Figure 7:
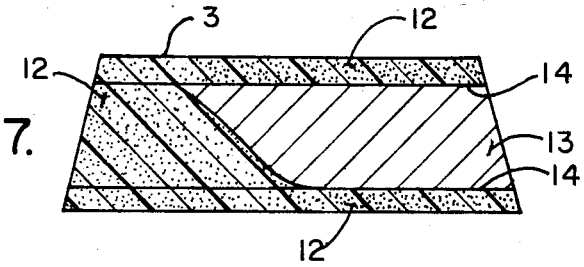
FIG. 7 is a similar view to the construction of that explained in FIG. 6.

FIG. 7 discloses how a further shock absorption plug 13, also of different density from the foam 12, forming the sole 3 of the shoe may be located within the cellular component 14, so as to add further resistance against pointed forces of transmission.

Figure 9:
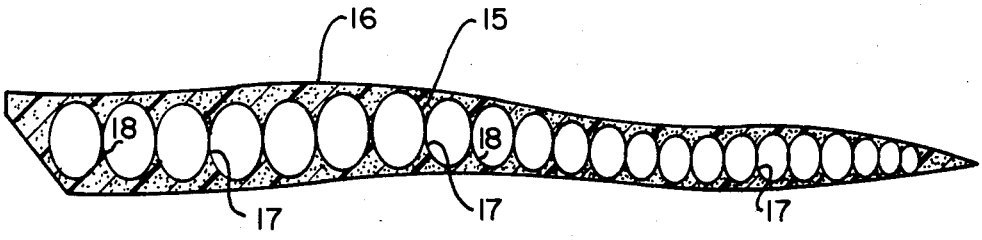
FIG. 9 is a longitudinal sectional view similar to that shown in FIG. 4, disclosing larger style cellular components formed of the insert for the sole of a running shoe.

In referring to FIG. 9, one other variation upon the location of the cellular insert of this invention, such as shown at 15, and located within a sole structure 16 for a jogging or running shoe is readily disclosed. In this particular instance, the cellular components 17 are arranged along the length of the sole structure, are of substantial heighth, interconnected together at their points of adjacency, as by strands of linking means, as at 18, and extend much higher and lower within the sole structure 16, in order to add to the means for resistance in transmission of forces of impact through the sole structure and to the foot of the athlete. In this particular instance, as noted, the foamed structure of the sole 16 does not the fill the cavaties contained within the cellular components 17, and therefore, force transmission may be effectively rejected through the arrangement of the cellular insert 15 of this particular invention. In this embodiment, the liners normally arranged above and below the component, may or may not be included.

Figure 10:
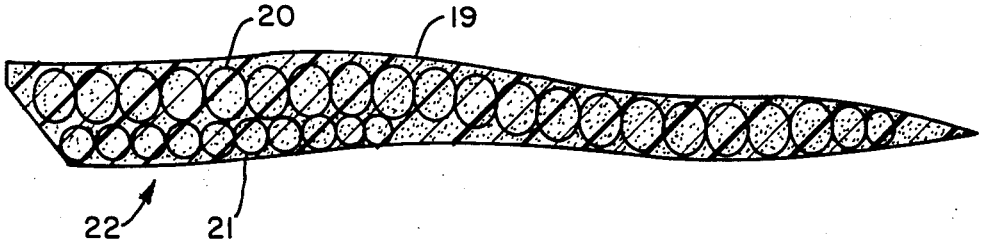
FIG. 10 is a longitudinal sectional view similar to that as shown in FIG. 4 disclosing a plurality of layers for the cellular components of the insert for the sole of a running shoe.

A further embodiment for a running shoe is shown in FIG. 10. In this particular instance, the sole structure 19 includes a series of cellular inserts, as at 20 and 21, as noted, and in the shown structure, the cellular inserts are provided at dual layers, particularly at the heel portion 22 of the shoe, and since this embodiment is of the jogging shoe variety, the greater forces of impact encountered by the shoe during its application is at the situs of the heel, which first impacts with the ground repeatedly during participation in a running exercise.

The cellular inserts and coil system for the invention as disclosed in FIGS. 9 and 10 are of the type that are directly encapsulated within the sole structure during its injection molding, and present a dual density polyurethan midsole structure that effectively resists excessive pressures. The direct injection process is a standard procedure utilized in the shoe making process, wherein the polyurethane foamed bottom sole structure is directly attached through molding to the shoe upper. In this particular instance, during shoe fabrication, in this manner, the cellular insert and coil system of this invention is arranged underneath the shoe upper, with the latter then being covered and encapsulated within the polyurethane form midsole, as it is foamed in place to complete a fabricated shoe, in this particular instance, of the athletic style. And, as previously explained, the coil system of this invention may be located at isolated locations, and while FIG. 10 may disclose a dual layered cellular insert embodied within the shoe structure, it is just as likely that only a single layer, or dual or more layer, of the coil system may be located only within a part of the sole portion of the shoe, in order to provide the greatest resistance against pressure at that location where forces at a maximum are encountered by the shoe, particularly while partaking in running, jogging, or during racing.

Figure 11:
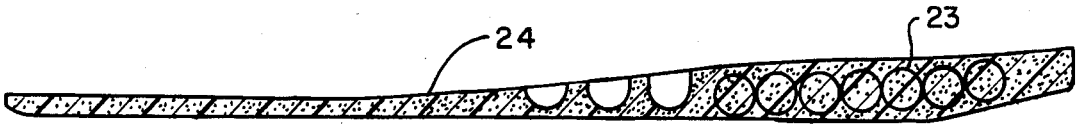
FIG. 11 discloses a formed sole for a court shoe showing the locating of the cellular insert for this invention within its sole portion.

FIG. 11 discloses the fabrication of the cellular system of this invention, comprising the cellular insert 23 that may be embedded integrally within the sole portion of, in this particular instance, another form of athletic shoe, or perhaps a court or basketball shoe. In this particular instance, the insert is located only within the heel portion for the sole 24 formed for the athletic shoe, and in this manner the sole may be formed of a polyurethane foam, or perhaps a dense form of polyurethane, or other polymer, such as may normally be used in the fabrication of the basketball shoe.

Figure 12:
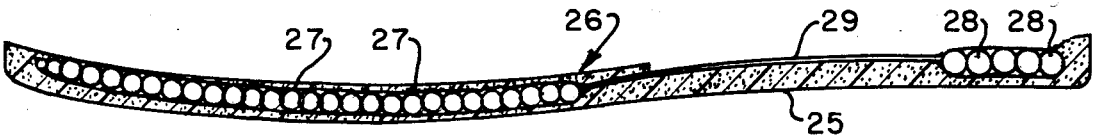
FIG. 12 discloses a longitudinal sectional view of the sole for a court or basketball shoe disclosing the cellular insert provided therein.

In addition to the foregoing, and referring to FIG. 12, the sole structure 25 for a court shoe may include the cellular insert or coil system 26 of this invention over its entire length, comprising a series of the interconnected cellular components 27 arranged along the longitudinal length of the sole at its frontal portion, and then interconnecting with a pair or more of the cellular components 28 embedded at the heel portion of the shoe sole. And, linking means 29 formed of the same or related polymer material from which the cellular components 27 and 28 are formed, may interconnect between the components arranged at the heel to the foreward sole portion for the disclosed shoe. Lining may or may not be provided. And, as can further be seen, the cellular inserts are arranged closer to the upper surface of the shoe sole, so that when the sole 25 is adhered into position along the bottom surface of the shoe upper, it presents its cushioning means, and force absorption means, more directly adjacent to the underside of the shoe insole, and just contiguously underneath of the foot of the athlete located therein.

Figure 13:
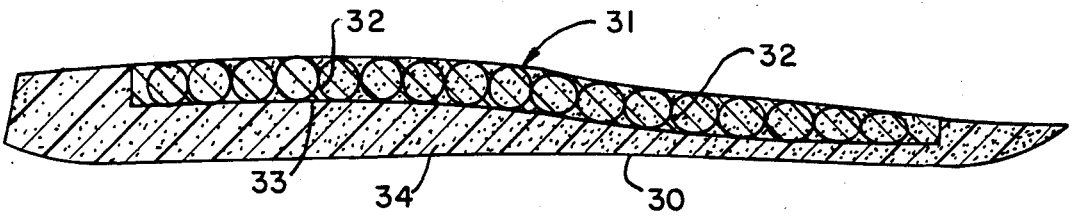
FIG. 13 is a longitudinal sectional view showing the cellular insert encapsulated within a midsole that is constructed into the formed sole for a running or other shoe.

Another variation upon the structure of this invention is shown in FIG. 13, wherein in this particular instance, this style of sole 30 may be adhered and connected to the upper of a running shoe. Once again, the cellular insert 31 comprising a series of interconnected cellular components 32 are intially embedded within a midsole bed of polyurethane or other foam material, as at 33, in order to provide for a prefabrication of the cushioning means of this invention. As an example, the density of this foam may be in the range of 0.3 to 0.35, having a Shore C hardness of about 25 to 30. The remaining portion of the the sole 30 may be as previously explained. Then, this particular midsole type of preconstructed cellular insert, with its encompassing foam, may be dropped into the hollowed pylon blocker unit that makes up the midsole wedge unit of the athletic shoe which is then put together with the shoe upper and outsole or other sole portion 34 when forming the finished product. In this manner, the blocker or insert 33 will be open on its top side so that the coil system 31 will be arranged in as close a proximity to the undersurface of the foot, and it is believed that such contiguity affords a greater resistance against transmission of forces of impact through the shoe sole, in order to better protect the foot of the athlete. The advantage of this particular method is that it offers increased cushioning and stability with sufficient foam stiffness that may be of enhancement to the safety of the athlete when utilizing this particular structure as a court shoe, or as a basketball shoe.

FIG. 14 discloses a slight modification to the structure of this invention, and its incorporation within the sole of an athletic shoe. And, FIG. 15 shows, from a side view the arrangement of the cellular inserts 35 within the foamed structure of the shoe sole. In this particular instance, as can be seen in FIG. 15, the insert is located adjacent the upper edge of the formed shoe sole, and includes a series of transversely arranged cellular components, as at 36, having a peripherally arranged cellular component 37 that is located around the side and marginal edges of the formed sole, arcuately encircling the back portion of the same, and then extending forwardly for extension transversely across the portion of the sole that is arranged under what is identified as the ball of the foot, with this particular component generally being shown at 38. Although the cellular insert of this particular style may be disclosed as embodied within the foamed structure of the sole for a running shoe, it is just as likely that this configuration could easily be embodied within the sole of a court shoe, or basketball shoe, since it is effective in resisting the forces of impact that are exerted upon the under surface of the shoe from a variety of locations, and not simply at the back end of the heel, as encountered during usage of the shoe during jogging.

Figure 22:
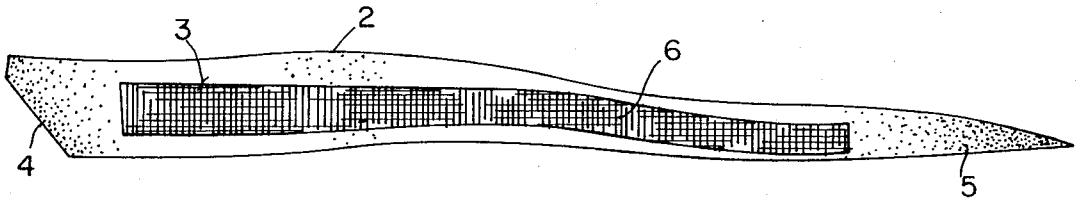
FIG. 22 is a longitudinal section similar to FIG. 4, but showing the cellular insert arranged longitudinally of the sole of the shoe.

FIG. 22 shows the cellular component 6 being arranged substantially longitudinally of the formed sole 2.

Variations within the spirit of this invention are envisioned for the woven cellular insert for this invention. For example, as can be seen in FIGS. 16 and 17, the cellular insert may be fabricated from a helical or spirally wound series of polymer, as can be noted, and which may, or may not, be linked together along their lateral edges into adjacent rows, as disclosed. Then, this composite may be located within the sole structure, when it is foamed in place, as previously described, to perform in the manner as envisioned for this invention. In addition, as can be seen in FIGS. 18 and 19, the wound strands of polymer may be shaped, in order to conform with that position within the sole structure where it locates. Also, the cellular components may be shaped having flattened or the like surfaces, as noted, and in this particular instance, being at its upper and lower surfaces, so as to dispose the surfaces to the upper and lower surfaces of the sole structure for the athletic shoe. Hence, pressure applied to the sole, as on its bottom surface, through performance in an event, will transmit that force to the lower surface of the structural component, and is believed to be absorbed by its vertical portions. In referring to FIGS. 20 and 21, it can be seen just how a particularly shaped wound strand of the polymer material forming the cellular component for this invention may be especially shaped to conform with the various sections of the athletic shoe in which it is disposed. For example, this particular structure shows the back portion for the running shoe, where it has its inclined edge, where noted, and which receives the brunt of the force of the runner during jogging. As noted, the wound material is shaped in order to conform with that particular design for the sole for the running shoe, in order to not only more conveniently fit for its embeddment within the sole structure, but effectively absorb any forces exerted at that location.

Variations or modifications to the structure of this invention may occur to those skilled in the art upon reviewing the subject matter of this invention. Such variations and modifications, if within the spirit of this invention, are intended to be encompassed within the scope of any claims to patent protection issuing upon this invention. The specific structure for this invention, as shown herein, and as defined, are set forth principally for illustrative purposes only.

Having thus described the invention what is claimed and desired to be secured by Letters Patent is:

1. A cushioning and impact absorption means for application within footwear of the type having a shoe upper affixed to a sole formed at least partially of a polymer like material, comprising, a shoe upper and a shoe sole, said upper secured to a cellular insert applied within the polymer like material, forming said sole, said cellular insert comprising layers of woven polymer material, and also comprising a series of cellular components formed of woven polymer material and arranged intermediate and connecting to said layers of material, siad cellular components having upper, lower and side surfaces, said layers of polymer material connecting to the upper and lower surfaces of said cellular components, said cellular components having cavities generally formed therethrough, with said formed cavities being arranged intermediate the said upper and lower surfaces of the cellular components, said series of cellular components provided therein being secured together by strands of linking means along their contiguous side surfaces, said cellular insert being arranged substantially aligned within the sole structure during shoe usage, said cellular inserts as being formed of a woven polymer material having a hardness greater than the polymer material forming said sole, whereby the cellular insert formed within the sole tending to effect absorption of any forces of impact encountered by the footwear during usage.

2. The invention of claim 1 and wherein said cellular components being formed of woven coils arranged intermediate the pair of woven layers of material, and said woven coils being arranged substantially transversely of the formed sole.

3. The invention of claim 1 and wherein said cellular components being formed as woven coils arranged intermediate the pair of layers of woven material and being arranged substantially longitudinally of the formed sole.

4. The invention of claim 2 or 3 and wherein said footwear comprising an athletic shoe.

5. The invention of claim 1 and wherein said footwear having a heel portion, and said cellular insert being provided embedded within the said cellular insert being provided embedded within the said heel portion of the formed footwear sole.

6. The invention of claim 5 and wherein said cellular insert comprising a singular layer of cellular components.

7. The invention of claim 1 and wherein said cellular insert being provided substantially throughout the entire footwear sole.

8. The invention of claim 1 and wherein said cellular insert comprising a singular layer of cellular components.

9. The invention of claim 1 and wherein said cellular insert being provided approximately centrally of the formed sole.

10. The invention of claim 1 and wherein the cavities of the cellular components being substantially filled with the polymer like material forming at least a part of the said footwear sole.

11. The invention of claim 1 wherein said woven cellular insert extending over the entire sole portion of the footwear.

12. The invention of claim 1 and wherein said woven cellular insert being substantially filled with the polymer like material forming at least a part of the said footwear sole.

* * * * *